United States Patent [19]

Reed

[11] 4,386,680

[45] Jun. 7, 1983

[54] EMERGENCY RESCUE SYSTEM

[75] Inventor: Waymon B. Reed, Gunter, Tex.

[73] Assignee: Multi-Story Transporters, Inc., Celina, Tex.

[21] Appl. No.: 328,870

[22] Filed: Dec. 9, 1981

Related U.S. Application Data

[63] Continuation-in-part of Ser. No. 243,365, Mar. 13, 1981, abandoned.

[51] Int. Cl.[3] ..... B66B 9/00

[52] U.S. Cl. ..... 187/6; 182/142

[58] Field of Search ..... 186/6, 1 R, 20, 22, 186/23, 26, 27, 95; 182/141, 142, 143, 144, 145, 147, 150, 10, 36, 37; 104/112, 113, 114, 122; 254/323, 325-327; 294/81 R; 212/148

[56] References Cited

U.S. PATENT DOCUMENTS 3,860,092 1/1975 Holmes ..... 187/6

4,018,306 4/1977 Lyons ..... 187/6

*Primary Examiner*—Kenneth W. Noland

*Attorney, Agent, or Firm*—Jerry W. Mills

[57] ABSTRACT

A system for enabling rescue of the occupants of a multistoried building. The system includes a lookout member adapted to be fixedly attached to the roof of the building by way of D-rings or the like. The lookout member is comprised of a crane adapted to overhang the edge of the building. A pulley is attached to one end of the crane and a first cable, of a length sufficient to extend from the ground to the pulley and from the pulley to the ground, is reeved through the pulley and has first and second ends. A drum is provided on the ground for reeling the first end of the cable in and out. A housing large enough to contain and support a plurality of people and adapted to be raised and lowered along the side of the building is provided in order to allow escape of occupants from the building in emergency situations. A yoke is adapted to be connected to the second end of the cable for being raised from the ground to the crane, to which it may be firmly but releasably attached. A second cable is provided. One end of it connects the yoke to the housing and the other end is connected to a power source located on the ground for raising and lowering the housing along the side of the building.

12 Claims, 8 Drawing Figures

EMERGENCY RESCUE SYSTEM

REFERENCE TO OTHER APPLICATION

This application is a continuation-in-part of application Ser. No. 243,365, filed Mar. 13, 1981 now abandoned.

TECHNICAL FIELD

This invention relates to emergency rescue devices, and more particularly to improved structure for rescuing occupants of multi-story buildings in the event of a fire or other emergency.

BACKGROUND ART

Fires in even the most modern multi-story buildings continue to pose an extreme hazard to life. High-rise buildings are particularly susceptible to the risk of fire because existing fire-fighting equipment and ladders will not reach more than the lower floors of such buildings, and access to the upper floors otherwise is only by interior stairs and elevator shafts. This presents a heretofore unsolved problem, because fire fighters find it difficult to get to the location of fire in high-rise buildings safely and quickly either by elevator or by stairway. Moreover, elevators inside a multi-story building often are found to be inadequate or dangerous during a fire because building power and central air conditioning systems are vulnerable to fire and smoke. So, too, many elevators are operated by the temperature of physical contact, which can be disastrous in the event of a fire. Such elevators may ascend or rise to the floor where the fire is burning and stop at that point with their doors open and with the occupants unable to move it in either direction. Lastly, stairways and elevator shafts often become air ducts for ascending smoke and heat and thus are not dependable as a means for building occupants or fire fighters to ascend or descend the building. A variety of publications have documented the aforesaid hazard to life, as evidenced in U.S. Pat. No. 4,018,306.

A number of rescue mechanisms for evacuating the occupants of a multi-story building in the event of fire have heretofore been described. These prior art systems generally are set forth in U.S. Pat. No. 4,018,306. Prior art devices also are typified by U.S. Pat. Nos. 284,180; 836,008; 3,860,092; 3,931,868; 4,018,306; 4,111,281; 4,121,693; and 4,122,917. Each of these prior art references shows efforts to devise external rescue devices which are dependable. None of the prior art devices, however, have met this need. For example, U.S. Pat. Nos. 284,180 and 836,008 show baskets which are raised and lowered by a fixedly positioned pulley. U.S. Pat. Nos. 3,860,092 discloses a complicated system involving at least five persons and using a succession of increasingly heavier cables. U.S. Pat. No. 4,018,306 discloses a system which is primarily designed for use along fixed vertical rails on the side of a building. It teaches that rescue be made only at emergency access openings provided in the building at locations adjacent the vertical railroad tracks. It further discloses the use of a complicated system of pulleys purportedly to maintain stability of a rescue vehicle. U.S. Pat. Nos. 4,111,281 and 4,121,693 and 4,122,197 each disclose various arrangements for rescue systems which present problems of system stability. None of these prior art systems have found public acceptance.

Thus, while the need for a dependable and expeditious yet reasonably economical apparatus to evacuate the occupants of a multi-story building has long been apparent, this need has not been met in the prior art. This is especially true for high-rise buildings. It is an object of this invention to overcome the prior art deficiencies and provide a rescue system which can be placed into operation within minutes, is inexpensive for the municipality or city to operate, and is inexpensive for building owners.

DISCLOSURE OF THE INVENTION

The present invention provides an improved emergency rescue device which is intended to gain widespread public acceptance through improved structure. The invention, when implemented, is anticipated to impose only a minimal capital expenditure requirement upon the owners of multi-story buildings, while providing an extremely stable system which can be installed and operated by no more than three persons to rescue building occupants from any window of a multi-story building, once the building has been equipped with D-rings on the roof thereof. In part, it utilizes the heretofore unrecognized fact that many multi-story buildings are provided with D-rings or similar window washing supports around the periphery of their roofs.

The improved emergency rescue system of the subject invention is comprised of a lookout which is adapted to be connected to the roof of a multi-story building by means of D-rings fixedly positioned on the building. The lookout may either be portable or permanently left on the building roof. The lookout includes a platform upon which is mounted a cantilevered top support means or crane means and at least one pulley attached to an end of the cantilevered top support means. A yoke lift cable is reeved through the pulley and has first and second ends. The yoke lift cable has a length sufficient to extend from the ground to the pulley and then back to the ground. The invention further comprises yoke means adapted to be raised from the ground to the top of the building by means of the yoke lift cable. The first end of the cable is coupled to the yoke means and the second end is connected to a means located on the ground for reeling the second end of the cable in and out. The yoke means, when fully raised, is operatively coupled to the cantilevered top support means. A housing large enough to contain and support a plurality of people is provided as well. The housing is raised and lowered by at least one lift cable which extends from the housing through the yoke means and back to a power source on the ground. At least one additional cable may be provided to impart further stability to the system. An emergency vehicle is provided to transport the housing and yoke means. The vehicle may also contain the means located on the ground for raising the yoke lift cable and the power source for at least one lift cable.

BRIEF SUMMARY OF THE INVENTION

It is an object of the invention to provide a dependable and economically sound means to evacuate safely the occupants of a multi-story building from any window or other means of egress from the building in the event of a fire.

Another object of the invention is to provide an emergency escape device which is dependent upon the building structurally only and is independent of the building for power and mechanical drives.

Another object of the invention is to provide an emergency escape device which can be expeditiously installed and operated by no more than two or three persons.

Another object of the invention is to provide an emergency escape device which can be used on any multi-story building in a city or other municipality while minimizing the cost to building owners of making any necessary structural modifications.

A further object of the invention is to provide an emergency escape device including a portable lift structure or lookout which is sufficiently lightweight so it can be transported to the site of a burning building by helicopter.

A further object of the invention is to provide an emergency escape device which is acceptable to the public and which finds widespread use and acceptance in order to obviate the prior art deficiencies.

The subject invention consists of three separate components which are used in conjunction with a building having a plurality of D-rings spaced appropriately around the periphery of the roof of the building. The three separate units are an emergency vehicle, a portable lookout and a fire-retardant rescue housing. The portable lookout further is comprised of a yoke which is normally carried on the emergency vehicle and is raised to and connected with the lookout in order to raise the fire retardant rescue housing. The emergency vehicle transports the housing and the yoke to the site of the fire and is adapted to provide all sources of power. Alternatively, the housing may be assigned to a building, and may be used through its construction phase, after which it may be used for maintenance as well as rescue.

BRIEF DESCRIPTION OF THE DRAWINGS

A more detailed understanding of the present invention may be had by reference to the following detailed description when taken in conjunction with the drawings wherein.

DETAILED DESCRIPTION

Figure 1:
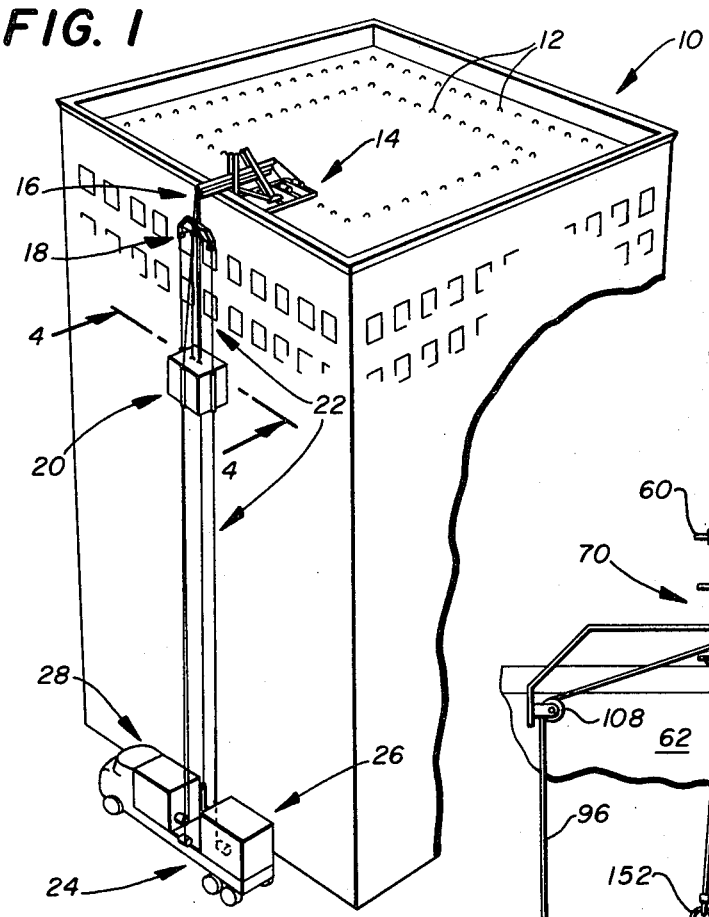
FIG. 1 is a plan view of the emergency rescue system of the present invention.
Figure 3:
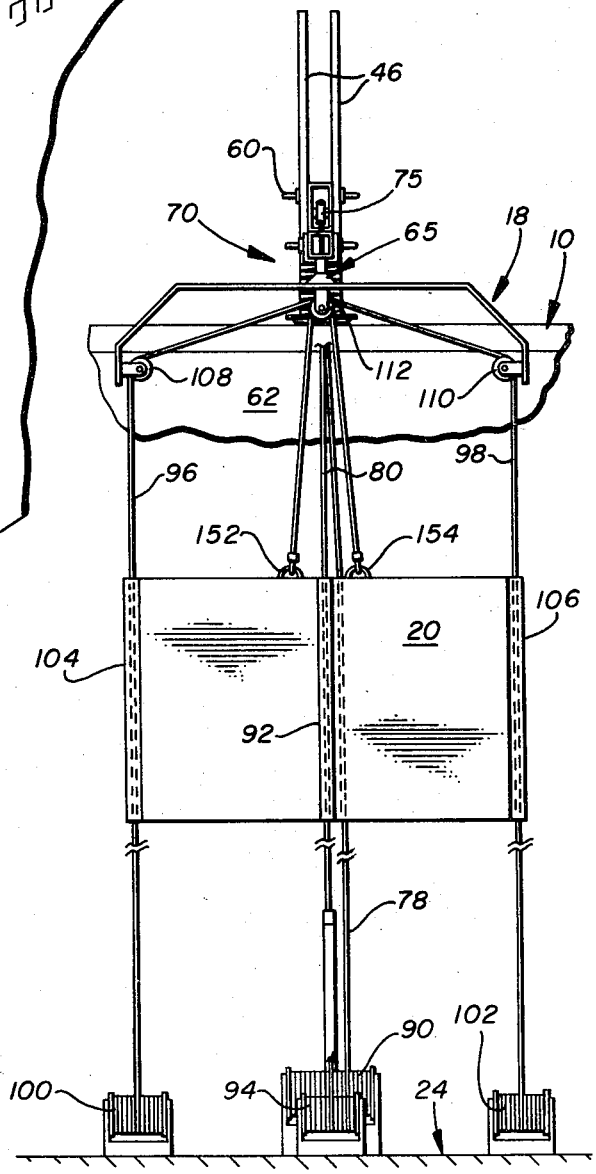
FIG. 3 is a side view of the yoke of the present invention as it interacts with the lookout and the fire retardant rescue housing.

In FIG. 1, a multi-story building 10 is shown. A plurality of D-rings 12 are spaced along the periphery of building 10. Alternatively, other roof mounts used for window washing apparatus may be used. The D-rings 12 are spaced so that a lookout 14 can be positioned between any adjacent pair of D-rings and coupled thereto, as will hereinafter be described. (In actual usage, the lookout 14 may be sized so as to conform to a building code requirement for D-ring spacing.) A portion 16 of the lookout 14 extends over the edge of the roof of building 10. A yoke member 18 is detachably coupled to portion 16 of lookout 14 by a quick release mechanism (shown in FIGS. 2, 3 and 5D) and provides a stabilized support for raising, lowering and suspending fire-retardant rescue housing 20. Three separate sets of cables, generally designated by 22, are used to lift yoke member 18 and to stabilize, guide and lift housing 20. As hereinafter more fully described, two of the sets of cables are carried on lookout 14, and the third set of cables is carried on a rescue vehicle 24. The power source for raising and lowering yoke member 18 and housing 20 by means of the aforesaid cables also is preferably carried on rescue vehicle 24 (as shown in FIG. 3). The rescue vehicle 24 also includes a first-aid section 26 and an equipment storage section 28.

Figure 2:
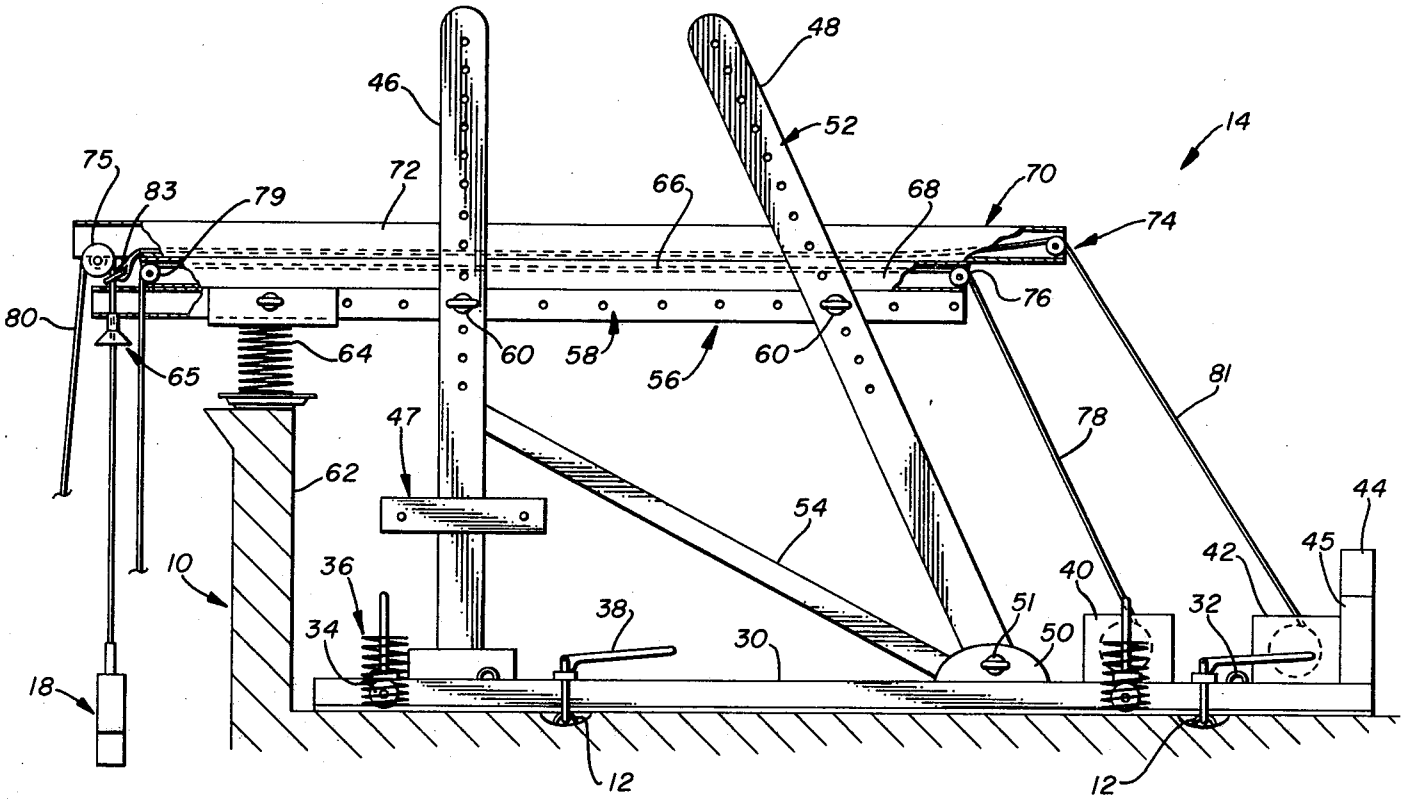
FIG. 2 is a side view of the lookout system of the present invention.

FIG. 2 is an enlarged side view of lookout 14. The lookout 14 may either be portable, in which case a helicopter can transport it from a central storage facility to the top of a multi-story building, or it may be permanently left on the roof of the building. In the latter case, it is possible to use the lookout for other functions such as window washing, maintenance and the like. The lookout 14 is comprised of a platform 30. A plurality of helicopter lift rings 32 are mounted on platform 30 and four retractable swivel casters 34 are provided on platform 30 and coact with springs 36 so that the lookout 14 may be rolled along the roof (or at the central storage facility) to the desired location. Once lookout 14 is in position on a roof it can then be secured to the roof in immobile fashion. Boomers 38 are mounted on platform 30 for securing the lookout 14 to D-rings 12 which are mounted, as indicated above, on the roof of building 10. As boomers 38 are activated, springs 34 are placed in tension until platform 30 is mounted flush on the roof. Alternatively, counter weights permanently maintained on the roof can be used for this purpose. Stabilizer cable drum 40 and yoke cable drum 42 also are mounted on platform 30 and are operatively connected to an electrical/mechanical drum power supply 44 by conventional means (not shown). An optional battery compartment 45 is also provided as a power source storage area. The stabilizer cable drum 40 and the yoke cable drum 42 may either be remotely electronically activated or may be manually operated to lower the cables to the ground, as described in more detail below.

A pair of support frames 46 and 48 also are mounted on platform 30. Support frame 46 is preferably stationary, and is mounted in a vertical position, while support frame 48 is pivotably connected to platform 30 at pivotal mount 50 by means of a pair of pivot pins 51. A portable ladder connector 47 is mounted on support frame 46, as shown. Support frames 46 and 48 each define therein a plurality of pairs of apertures 52, the function of which will be described in detail hereinbelow. Brace 54 extends between pivotal mount 50 and support frame 46 and is rigidly connected at both ends. A main lift beam 56 extends in a generally horizontal direction and is of a length sufficient so that portion 16 (as shown in FIG. 1) extends over the edge of the building 10 when the lookout 14 is coupled to D-rings 12.

The main lift beam 56 defines therein a plurality of apertures 58, and is connected to support frames 46 and 48 by means of two pairs of coupling pins 60 which extend through apertures 52 in the support frames 46 and 48 and through apertures 58 thereof. The main lift beam 56 can be adjusted in height so as to extend over the top wall 62 of building 10 by appropriately choosing the apertures 52 and 58 through which coupling pins 60 are inserted. The forward portion of main lift beam 56 may be supported on top wall 62 by spring set 64. The main lift beam 56 and support frames 46 and 48 are juxtaposed in a counter-balance arrangement so that a single person can adjust the height of the main lift beam and adjust spring set 64 before the lookout 14 is transported to the roof of a multi-story building 10. The main lift beam 56 defines therein an aperture in the vertical plane of the forward portion thereof.

A yoke coupler with a flared guide 65 is attached to the bottom of the forward portion of main lift beam 56, adjacent the end thereof which is adapted to extend over the edge of building 10, and about the aperture in the vertical plane. The function of the yoke coupler 65 will also be described hereinafter.

Stabilizer beam 66 is mounted on main lift beam 56. The stabilizer beam 66 defines along its longitudinal axis a passageway 68. Mounted on stabilizer beam 66 is yoke lift beam 70, which defines along its longitudinal axis a passageway 72. A pulley 74 is operatively mounted in beam 70 adjacent one end of passageway 72 and a pulley 76 is operatively mounted therein adjacent one end of passageway 68. A pulley 79 is operatively mounted at the other end of passageway 68, and a pulley 75 also is operatively mounted adjacent the other end of passageway 72 of yoke lift beam 70. Alternatively, a raced sheave (not shown) can be operatively mounted in passageway 72 in place of pulley 75.

A stabilizer cable 78 extends from stabilizer cable drum 40 around pulley 76 through stabilizer beam passageway 68 around pulley 79 of passageway 68 and out the end thereof. The stabilizer cable 78 is of sufficient length so as to be able to reach the ground from the roof of the building. A yoke cable 80 is shown positioned about yoke lift pulley 75. A yoke retrieval cable 81 is affixed at one end to drum 42 and is connected to yoke cable 80 at its other end by means of slip ring 83. The two ends of yoke cable 80 together extend from yoke drum 42 over or under pulley 74 through passageway 72. Each said end is adapted to extend around an opposite portion of yoke lift pulley 75. One end of yoke cable 80 extends through the aperture in the main lift beam and then through yoke coupler 65. The yoke cable 80 is rewound by means of retrieval cable 81 which pulls cable 80 to drum 42 centrally of cable 80. Cable 80 is then rewound in doubled up fashion until the weight (shown in FIG. 5A contacts the lookout 14. Yoke cable 80 has an electrical core which may be charged when the cable is wound on the drum. Then, in operation, when the yoke is raised, as it contacts yoke coupler 65, a signal may be activated on the ground.

Lookout 14 and its components can be constructed of any strong, lightweight material, although preferably it will be constructed from tubular material. The material chosen should not be readily flammable and should be sufficiently lightweight so that the lookout 14 may be transported by a helicopter and so that the beams can be adjusted on the frames by a single person to whatever height is appropriate in the circumstances, as described above. At the same time, the material must be strong enough to serve the functions described hereinbelow. If the lookout is permanently mounted, it will be inspected periodically by a building or fire inspector.

Figure 5D:
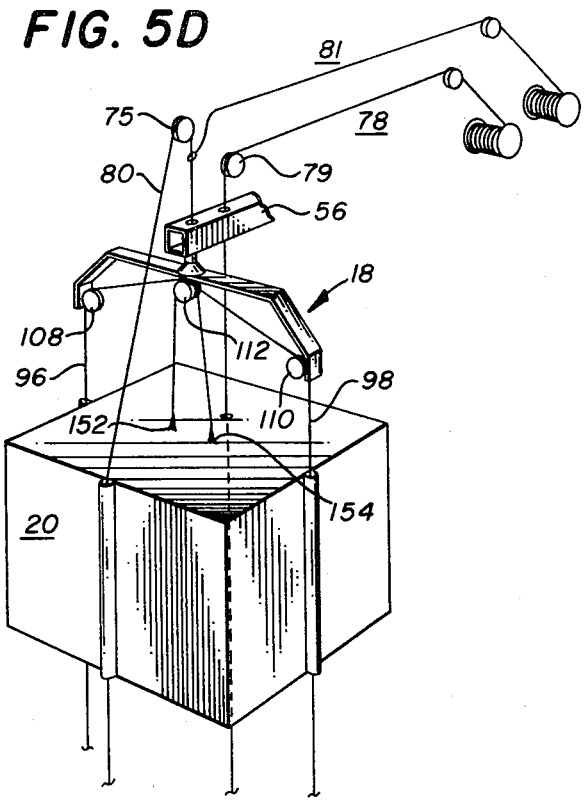
FIG. 5D is a schematic view of the yoke coupled to the fire retardant rescue housing wherein the housing has been raised to its uppermost position.
Figure 4:
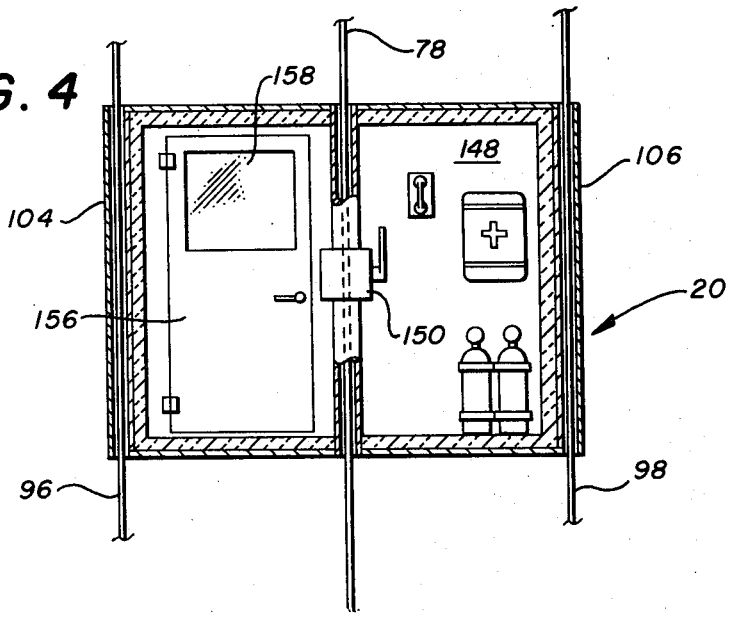
FIG. 4 is a sectional view of the fire retardant rescue housing of FIG. 1.
Figure 5A:
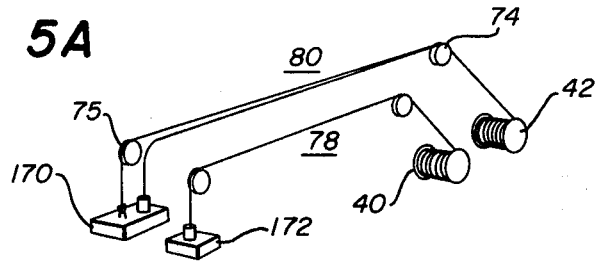
FIG. 5A is a schematic view of the lookout cables of the subject invention in a stored position.
Figure 5B:
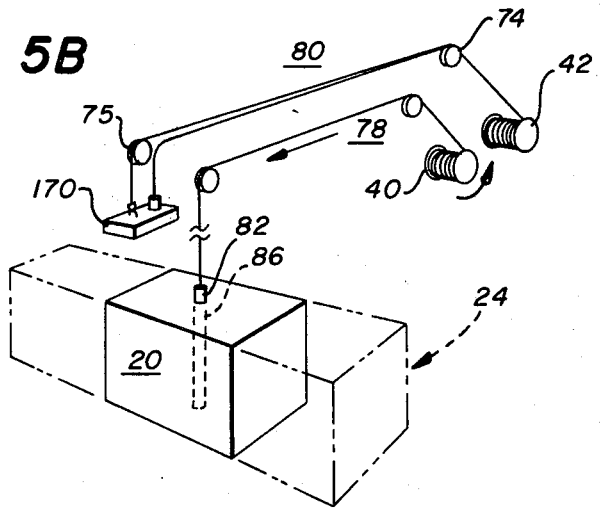
FIG. 5B is a further schematic view of the yoke cables wherein the stabilizer cable has been lowered and coupled.
Figure 5C:
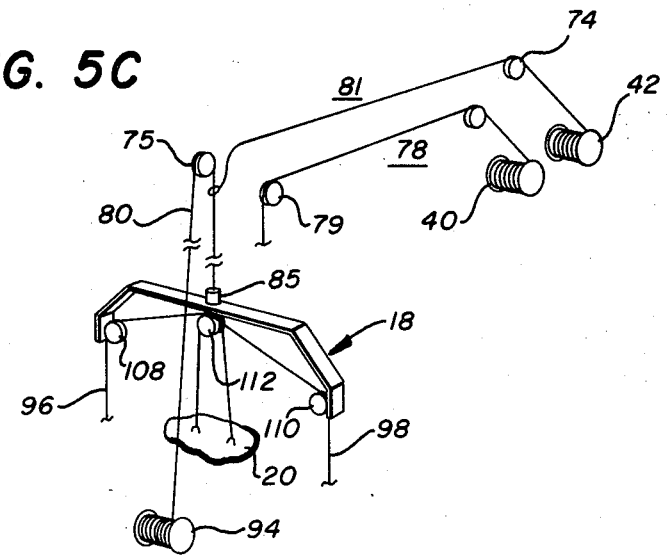
FIG. 5C is a schematic view of the yoke of the subject invention and its interaction with the lookout cables as well as its interconnections with the rescue housing.
Figure 5D:
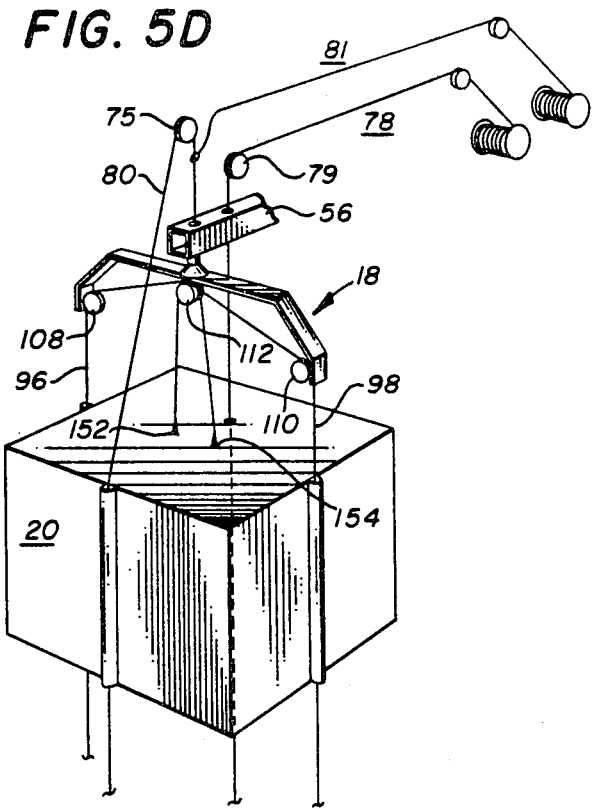
Figure 4:
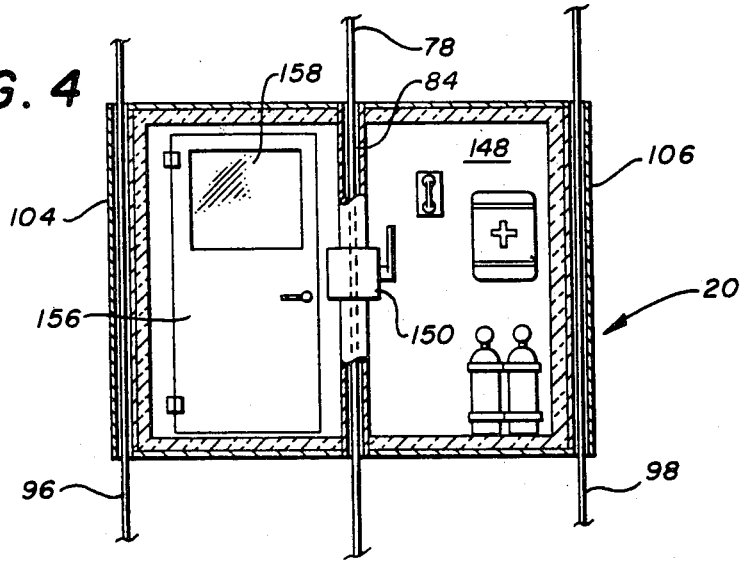

Referring now primarily to FIGS. 3 and 5C, yoke member 18 is coupled to yoke coupler 65 by a coupling mechanism 85 (shown in FIG. 5C) carried on the yoke member 18 which interacts with the yoke coupler 65 that depends from yoke lift beam 70. In this way, the yoke member 18 is firmly but detachably connected to yoke lift beam 70. Fire-retardant rescue housing 20 defines a passageway 84 (FIG. 4) along the vertical axis through which stabilizer cable 78 is adapted to extend. When housing 20 is in position to be carried on vehicle 24 to the site of a fire or other emergency rigid stabilizer cable connecting member 86, having a quick connect mechanism 82 at its upper portion, extends through passageway 84 to a point above housing 20. Attached to the end of stabilizer cable 78 is a stabilizer cable connector 88 which is adapted to be coupled to quick connect mechanism of connecting member 86 (FIG. 5B). Tension drum 90 on vehicle 24 keeps stabilizer cable 78 taut after the stabilizer cable 78 is connected to connecting member 86.

As shown in FIGS. 3 and 5C, one end of yoke cable 80 is operatively adapted to be attached to the top of yoke member 18 by coupling mechanism 85 as the yoke is carried loosely in vehicle 24. The other end of yoke cable 18 passes around pulley 75, through yoke cable guide means 92 on housing 20 and is connected to yoke lift drum 94. Main lift cables 96 and 98 are connected at one end each thereof to main lift drums 100 and 102 and pass through main lift cable guides 104 and 106 on fire-retardant rescue housing 20 through pulleys 108 and 110 which are mounted on the periphery of yoke member 18, through a pair of pulleys 112 mounted centrally of yoke member 18 and along the same axis, and then down to the top of fire-retardant rescue housing 20 which they are adapted to be connected to the housing 20 by a pair of connecting mechanisms 152 and 154.

Referring next to FIG. 4, a sectional view of fire retardant rescue housing 20 along section 4—4 of FIG. 1 is shown. The passenger compartment generally is indicated by 148. As shown, stabilizer cable 78 passes through the passenger compartment 148 of housing 20. An emergency braking system 150 is provided and coacts with stabilizer cable 78. Main lift cables 96 and 98 pass through guides 104 and 106 and the adapted to connect to the top of housing 20 by means of connectors attached to the end of said cables and which coact with connecting mechanisms 152 and 154 mounted on the top of housing 20 (FIG. 5D). Wall 156 adjacent to the building is adapted to open inwardly as by door, or has a slidable door therein. A platform from the floor decking is jacked out by the operator within the housing to make contact with the building so as to define a walkway between any window of the building and the passenger compartment 148. A top portion 158 of wall 156 may be comprised of transparent plexiglass or like material. The top portion of the housing 20 may have an aperture therein (normally closed), so that persons on the roof may descend into the housing by means of a ladder connected to portable ladder connector 47.

A better understanding of the operation of the cable system can be obtained from the sequence in FIGS. 5A–5D. Referring first to FIG. 5A, stabilizer cable 78 and yoke cable 80 are schematically shown in their retracted positions. In this position weight 170 is shown connected to both ends of yoke cable 80, while one end of stabilizer cable 78 is connected to weight 172, as shown. The weights 170 and 172 are of sufficient size to prevent the ends of cables 70 and 78 from being drawn through the beams to drums 42 and 40, and of sufficient weight to cause the ends of the cables to descend from the top of the building to the ground as drums 40 and 42 cause cables 78 and 80 to be played out.

FIG. 5B shows the next step in the sequence. There, stabilizer cable 78 has been lowered to the ground, weight 172 has been removed, and stabilizer cable 78 has been coupled to connecting member 86 while housing 20 is on vehicle 24. Next, in FIG. 5C, yoke cable 80 has been extended around pulley 75. One end of yoke cable 80 has been connected to yoke member 18 and the other end connected to yoke lit drum 94 so that yoke member 18 is being raised. FIG. 5D schematically shows yoke member 18 lifted to main lift beam 56 and coupled to yoke coupler 65. Housing 20 is shown being raised by main lift cables 96 and 98 to the desired height.

In operation, when using a portable lookout 14, the burning multi-story building first is identified. The fire personnel previously have been provided with the necessary information regarding wall height for all multi-story buildings, inasmuch as it is anticipated that such information would previously have been recorded pursuant to fire code requirements. The recorded information would include building height, spacing between floors, and the details of exit means such as windows. An individual thus makes appropriate adjustments to coupling pins 60 so that the stabilizer beam 66, yoke beam 70 and main lift beam 56 are all at an appropriate height. Lookout tension spring set 64 is also adjusted to an appropriate height. Then the portable lookout 14 is transported by helicopter to the top of the burning building 10. The helicopter need not set down in order to place the lookout 14 on the roof and to allow one fireman to disembark. The so-disembarked fireman rolls the lookout 14 to whatever location is desired and then connects the lookout 14 to D-rings 12 by means of boomers 38. The operator can then mechanically activate yoke cable drum 42 and stabilizer cable drum 40, or these drums can be activated automatically, as desired. The operator then either can reembark in the helicopter, which can hover in the vicinity of the building during those few minutes in which the portable lookout 14 is being put into place, or he can wait until the system is connected and enter the rescue housing 20 via a portable ladder which can be connected to portable ladder connector 47.

At the same time, rescue vehicle 24 is driven to the site. The vehicle may carry its own power, or may draw power from an adjacent building, but not from the burning building. Once the lookout 14 is in place, yoke cable 80 and stabilizer cable 78 are lowered to the ground. Optionally, if lookout 14 is permanently mounted on the building, the cables may be stored in their extended positions, subject to appropriate safeguards. One ground operator then connects the stabilizer cable 78 to the stabilizer connecting member 86 and tightens the stabilizer cable 78 by means of drum 90. Then, one end of the yoke cable 80 is connected to the yoke member 18 and the other end is connected to the yoke drum 94. The yoke drum 94 is then activated and the yoke member 18 is raised to the yoke connector 65 on the main lift beam 56. The connection system between the yoke member 18 and the quick contact 65 can either be an electrical or a mechanical one, so long as it can be remotely engaged and disengaged from the ground. As the yoke member 18 is raised to the main lift beam 56, the main lift cables 96 and 98 are played out so that when the yoke member 18 is mounted on the main lift beam 56, the main lift cables 96 and 98 can then be retracted by means of main lift cable drums 100 and 102 to raise the housing 20 to whatever height is appropriate under the circumstances. In the preferred embodiment, an operator on the ground controls the housing height by means of a buzzer and bell system which is known in the crane art, along with ground-housing communications. An operator riding in housing 20 then jacks out the platform from the floor decking and open rear wall 156 so that a walkway is created between the housing and a window wherein occupants of the burning building are congregated. Once the persons have been evacuated into the rescue housing, the rear wall 156 is closed and the rescue housing 20 is lowered to the ground. If any of the occupants are injured, they may be treated in first-aid section 26 of vehicle 24. The above operation is reversed to dismantle it.

The rescue housing 20 can be made of any appropriate fire-retardant material which is of sufficient strength to convey a plurality of persons and to bear up under falling objects, yet not so heavy as to impose an undue strain on the lift cables 96 and 98, the lift cable drums 100 and 102 and the lookout 14. The rescue housing 20 may also be designed to be portable, if need be. Similarly, the yoke member can be made of any suitably strong yet lightweight material.

In the alternative, a permanent lookout 14 can be mounted on the roof of the building 10. In that case, a person would need to move the lookout 14 along the roof to the appropriate position and then appropriately lock it to the D-rings 12. When not in energency use, the lookout 14 can be used for various maintenance activities.

The improved device described herein has significant advantages over prior art devices, as described above. Although particular embodiments of the invention have been illustrated in the drawings and described herein, it will be understood that the invention is not limited to the embodiment disclosed, but is capable of rearrangement, modification and substitution of parts and elements without departing from the spirit of the invention.

I claim:

1. A system for enabling rescue of the occupants of a building comprising:

a lookout member to be attached to the roof of said building, said lookout member being comprised of a crane means to overhang the edge of said building, a pulley attached to one end of said crane means, a first cable reeved through said pulley and having first and second ends, said first cable having a length sufficient to extend from the ground to said pulley and from said pulley back to the ground;

means located on the ground for reeling said first end of said cable in and out;

a housing large enough to contain and support a plurality of people and to be raised and lowered along the side of the building in order to allow escape of occupants of the building in emergency situations;

a yoke means to be connected to said second end of said cable for being raised from the ground to the crane means and operatively and releasably coupled thereto, said yoke means being carried to the building and raised from the ground in an emergency; and a second cable operatively connecting said yoke means to said housing for providing stability to said housing as said housing is raised and lowered along the side of the building and for raising and lowering said housing along the side of the building, whereby said system is operated by first fixedly attaching said lookout member to said roof, lowering said first and second ends of said first cable to the ground, coupling one end thereof to said yoke means and the other end thereof to said means located on the ground for raising said yoke means to said crane means and coupling said yoke means to said crane means, and then raising said housing as appropriate by said second cable and thereafter disassembling said yoke means by reversing such steps.

2. The apparatus of claim 1, further comprising a vehicle for transporting said housing and said yoke means to the site of the emergency, said vehicle also transporting said means for reeling sid first end of said cable in and out, and further having means for raising and lowering said housing operatively coupled to said second cable.

3. The apparatus of claim 2, further comprising connecting means for releasably connecting said crane means and said yoke means, said connecting means being mounted on said yoke means and said crane means.

4. The device of claim 3, further comprising a second pulley mounted on said lookout member, a third cable operatively mounted on said crane means and which extends from the building to said vehicle, said vehicle further comprised of means to keep said third cable taut, said housing defining guide means therein for said third cable, whereby said third cable is extended from said crane means through said guide means to said means to keep said third cable taut, additional stability is imparted to said housing as said housing is raised and lowered.

5. The device of claim 4 wherein said vehicle further defines a first-aid section and an equipment storage section.

6. The device of claim 5 wherein said lookout member is further comprised of a platform, coupling means mounted on said platform for coupling said platform to the roof of said building by means of D-rings mounted on said roof, first and second drum control means mounted on said platform and operatively coupled to said first and third cables for automatic and manual operation.

7. The device of claim 6, wherein said crane means is comprised of first and second support frames, each of said first and second support frames defining therein a plurality of pairs of apertures, said first support frame being fixedly mounted on said platform and said second support frame being pivotably mounted on said platform;

first, second and third beams, said first beam defining therein a plurality of apertures along its longitudinal axis, said second beam mounted on said first beam and said third beam mounted on said second beam, said second beam defining therein a passageway for said third cable and said third beam defining therein a passageway or said first cable; and a pair of coupling pins, whereby said first, second and third beams are operatively coupled to said first and second support frames.

8. The device of claim 7, wherein said platform is further comprised of a plurality of retractable wheels and a plurality of helicopter cable connectors.

9. The device of claim 7, wherein said housing further comprises an emergency brake means operatively coupled to aid third cable.

10. The system of claim 1, wherein said building has a plurality of D-rings permanently affixed along the periphery of the roof thereof, said lookout member to be attached to the roof by means of said D-rings by coupling means mounted on said lookout member.

11. The system of claim 1, wherein said lookout member is permanently stationed on the roof of said building, whereby it may be used, in addition to its rescue function, in building construction and maintenance activities.

12. A system for enabling rescue of the occupants from any window of a multi-story building having a plurality of D-rings permanently affixed along the periphery of the roof thereof, comprising:

(a) a lookout member to be positioned at any desired location along the periphery of the roof of said building, said lookout member being comprised of:

a platform;

coupling means mounted on said platform for coupling said platform to the roof of said building by means of said D-rings;

first and second drum members mounted on said platform;

first and second drum control means operatively coupled to said first and second drum members for automatic and manual operation of said drum members;

at least one cantilevered top support means mounted on said platform and which extends over the edge of the roof of said building when said lookout member is attached to said building;

yoke connecting means mounted on said at least one cantilevered top support means;

a stabilizer cable reeved through a first pulley member along said at least one cantilevered top support means and having a length sufficient to extend from said first pulley member to the ground; and a yoke cable reeved through a second pulley member along said at least one cantilevered top support means and having first and second ends and having a length sufficient to extend from the ground to said second pulley member and back to the ground;

said first and second drum members operably coupled to said stabilizer cable and said yoke cable, respectively;

(b) a fire retardant rescue housing large enough to contain and support a plurality of people, said housing defining an aperture therein for said stabilizer cable whereby said fire-retardant rescue housing may travel along said stabilizer cable in stabilized fashion, yoke cable guide means mounted along a side of said fire retardant rescue housing for guiding said fire-retardant rescue housing along said yoke cable;

(c) a yoke means carried on said fire-retardant rescue vehicle and to be raised to the top of a building by means of said yoke cable, connecting means attached to said yoke means for releasably connecting said yoke means to said yoke connecting means of said lookout member, a plurality of main cable pulley members mounted on said yoke means, yoke cable connecting means mounted on said yoke for connecting said yoke means to said yoke cable, and at least one main cable reeved through said main cable pulley members and having first and second ends, said first end being coupled to said fire-retardant rescue housing; and (d) a vehicle for transporting said fire-retardant rescue housing to said building, said vehicle having main cable lift drum means coupled to said second end of said main lift cable for raising and lowering said fire-retardant rescue housing to and from said yoke means after said yoke means has been connected to said lookout member, said vehicle further having stabilizer cable connecting means to extend through the aperture in said fire-retardant rescue housing when said housing is on said vehicle, and yoke cable lift driven means operatively connected to said yoke cable for raising and lowering said yoke means.

* * * * *